US005885106A

United States Patent [19]

Genta et al.

[11] Patent Number: 5,885,106

[45] Date of Patent: Mar. 23, 1999

[54] CONNECTOR WITH CONTACT EJECTOR MEANS

[75] Inventors: Alessandro Genta, Torino; Pier Carlo Bigotto, Cascine Vica-Rivoli, both of Italy

[73] Assignee: Framatome Connectors International S.A., Courbevoie, France

[21] Appl. No.: 849,830

[22] PCT Filed: Dec. 15, 1995

[86] PCT No.: PCT/EP95/04982

§ 371 Date: Aug. 21, 1997

§ 102(e) Date: Aug. 21, 1997

[87] PCT Pub. No.: WO96/19018

PCT Pub. Date: Jun. 20, 1996

[30] Foreign Application Priority Data

Dec. 16, 1994 [IT] Italy ..... T094A 1027

[51] Int. Cl.[6] ..... H01R 13/40

[52] U.S. Cl. ..... 439/595; 439/744

[58] Field of Search ..... 439/595, 744

[56] References Cited

U.S. PATENT DOCUMENTS

| | | | |
|---|---|---|---|
| 4,253,718 | 3/1981 | Bungo | 439/595 |
| 4,679,874 | 7/1987 | Saijo et al. | 439/595 |
| 4,721,482 | 1/1988 | Fukuda et al. | 439/595 |
| 5,088,938 | 2/1992 | Murakami et al. | 439/595 |
| 5,120,269 | 6/1992 | Endo et al. | 439/595 |
| 5,743,761 | 4/1998 | Kawase | 439/595 |

FOREIGN PATENT DOCUMENTS 0 374 455 11/1989 European Pat. Off. .

*Primary Examiner*—Neil Abrams
*Assistant Examiner*—Jean F. Duverne
*Attorney, Agent, or Firm*—Pollock, Vande Sande & Amernick

[57] ABSTRACT

An electric connector having an insulating casing with at least one axial cavity, an electric terminal retained inside the cavity by primary retaining means, and a secondary retaining device in turn having a first movable element which snaps onto the casing for ensuring correct engagement and preventing release of the terminal by the primary retaining means. The secondary retaining device also has a second movable element interposed between the first movable element and the terminal, and which, when subjected to thrust by the first movable element, cooperates with the terminal for at least partially expelling it from the cavity in the event the terminal is not correctly engaged by the primary retaining means, the first movable element presenting an elastically deformable portion which is released from the second movable element in the event the terminal is correctly engaged by the primary retaining means.

6 Claims, 3 Drawing Sheets

CONNECTOR WITH CONTACT EJECTOR MEANS

TECHNICAL FIELD OF THE INVENTION

The present invention relates to an electric connector, in particular of the type comprising an insulating outer casing defining at least one axial cavity, and an electric terminal housed and retained inside the cavity by primary retaining means.

BACKGROUND ART OF THE INVENTION

Known electric terminals of the aforementioned type comprise a secondary retaining device for ensuring correct insertion as well as retention of the terminals inside the respective cavities.

The secondary retaining device normally comprises a movable element which snaps onto the casing, and which may either be hinged integral with the casing or consist of a separate element. In either case, snap-on connection of the movable element to the casing is only possible when the terminal is correctly inserted and retained inside the cavity by the primary retaining means which normally consist of an elastically deformable lance forming part of the casing. In the event that the terminal is not properly or fully inserted, residual deformation of the primary retaining means prevents the movable element from being assembled, thus enabling the fault to be detected.

Known connectors of the type briefly described above present several drawbacks. In the event that the terminal is not fully inserted inside the cavity, the movable element may be forced into the engaged position despite interference with the primary retaining means, e.g., by breaking or deforming the contacting parts, in which case improper insertion of the terminal may go undetected due, for example, to the terminal being so positioned as to determine a precarious electrical contact. In applications, however, in which the connector is subjected to vibration, as on a motor vehicle, it is only a question of time before the connection is cut off, with all the obvious consequences this entails.

Moreover, known secondary retaining devices provide for detecting the presence of at least one improperly inserted terminal, but not for detecting which terminal is at fault.

SUMMARY OF INVENTION

It is an object of the present invention to provide an electric connector designed to overcome the aforementioned drawbacks typically associated with known connectors.

According to the present invention, there is provided an electric connector comprising an insulating casing with at least one axial cavity; at least one electric terminal housed inside the cavity; primary retaining means for retaining the terminal inside the cavity; and secondary retaining means in turn comprising at least a first movable element designed to snap into a closed position on the casing and to cooperate in this closed position with this primary retaining means, for ensuring correct engagement and preventing release of the terminal by the primary retaining means. The secondary retaining means comprise at least a second movable element interposed between the first movable element and the terminal, and which provides for transmitting to the terminal the thrust exerted on the first movable element, when the first movable element is moved towards the closed position, so as to at least partially expel the terminal from the cavity in the event the terminal is not correctly engaged by the primary retaining means; the first and the second movable elements having respective engagement portions cooperating mutually when subjected to the thrust; and at least one of the portions being elastically deformable by the thrust, for releasing the first movable element from the terminal in the event the terminal is correctly engaged by the primary retaining means.

BRIEF DESCRIPTION OF THE DRAWINGS

A preferred, embodiment of the present invention will be described by way of example with reference to the accompanying drawings, in which.

DESCRIPTION OF PREFERRED EMBODIMENT BEST MODE FOR CARRYING OUT THE INVENTION

Figure 6:
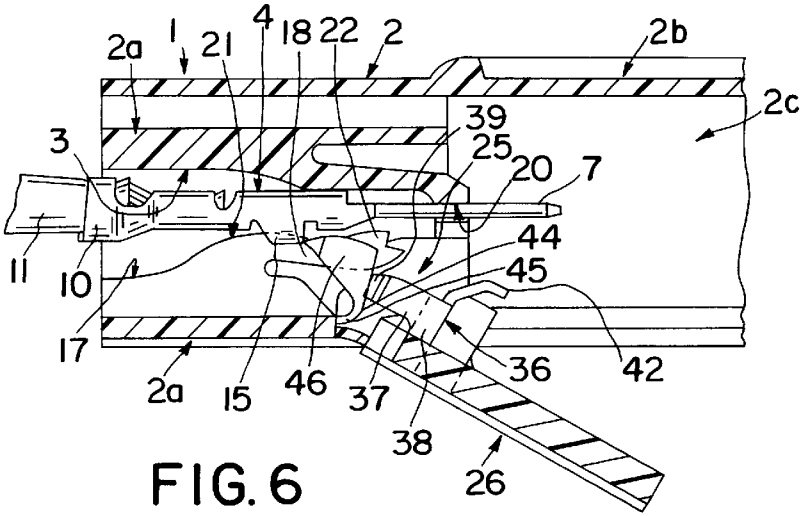
FIGS. 4, 5 and 6 show longitudinal sections, as in FIG. 3, of the various assembly positions of the connector in the event one of the terminals is not fully inserted.
Figure 5:
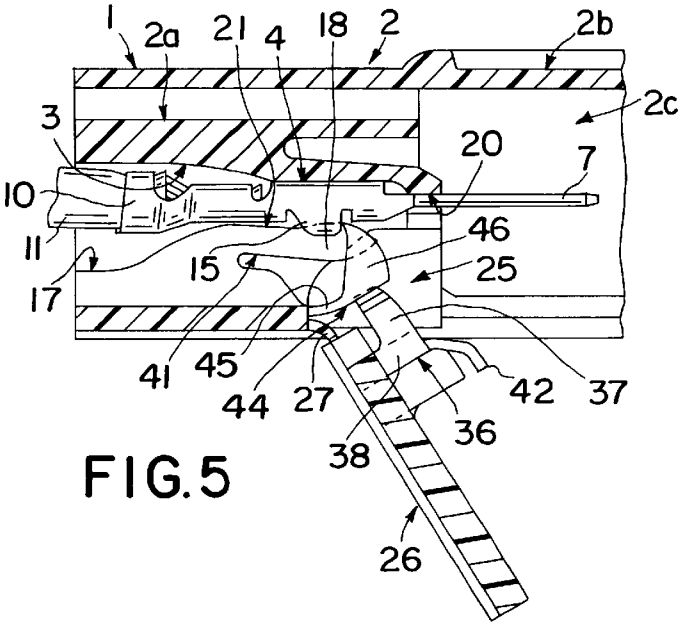
Figure 1:
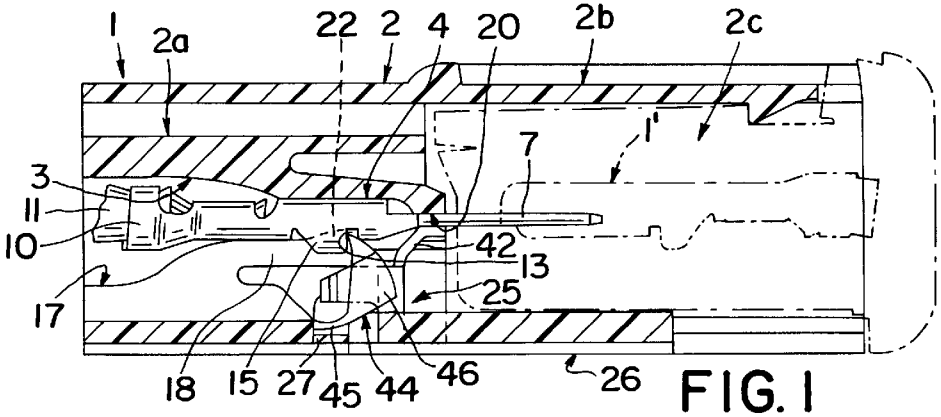
FIG. 1 shows a longitudinal in-service section of an electric connector in accordance with the teachings of the present invention.

FIG. 1 indicates an electric connector which comprises an insulating casing 2 defining a number of longitudinal through cavities 3 (only one is shown), and a number of male electric terminals 4 housed and retained inside respective cavities 3 by primary retaining means to be described in detail hereinbelow.

Figure 2:
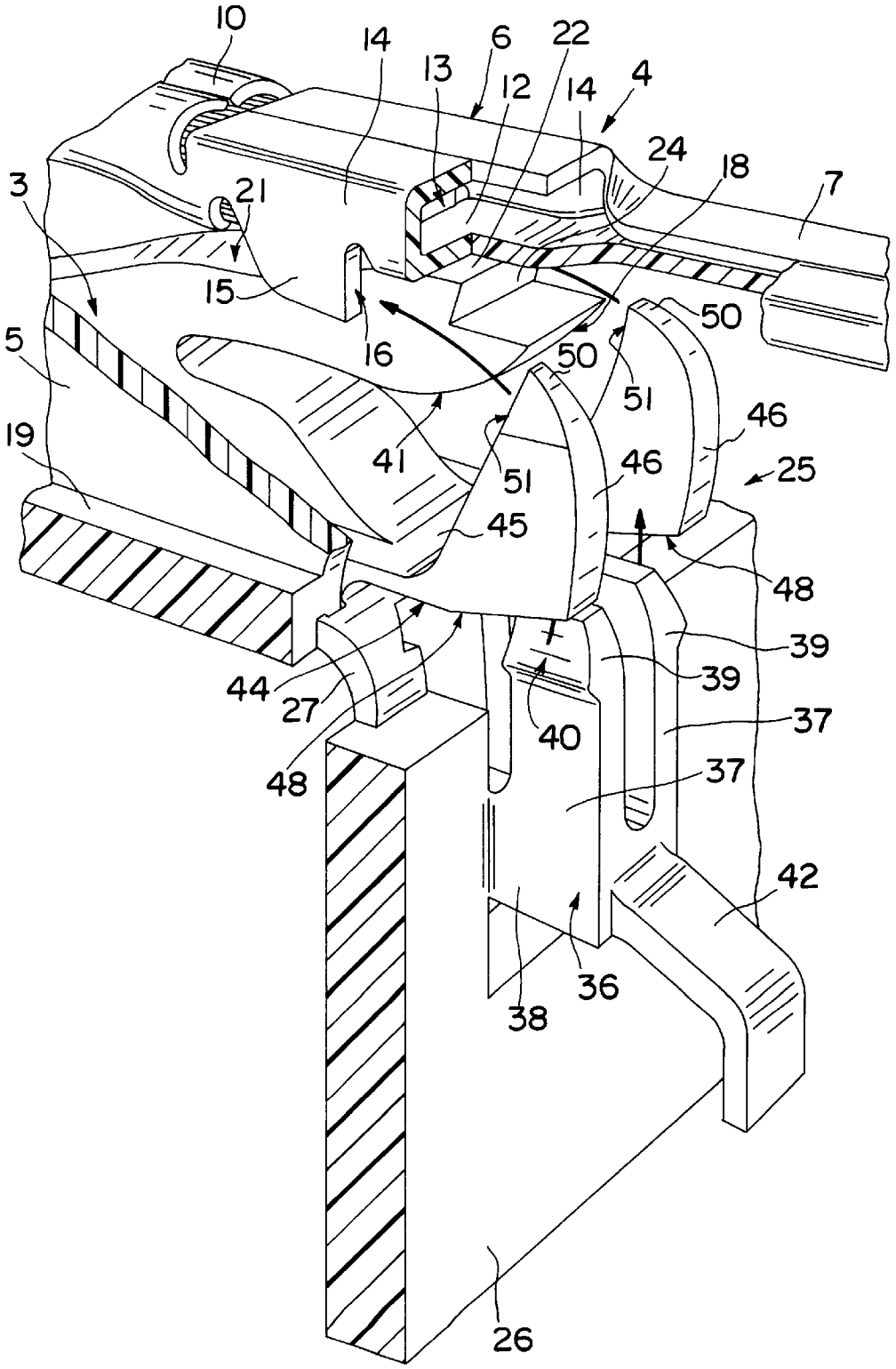
FIG. 2 shows a partial view in perspective of the secondary retaining device of the FIG. 1 connector.

Casing 2 comprises a substantially parallelepiped rear portion 2*a* in which cavities 3, defined laterally by walls 5 (FIG. 2), are formed; and a hollow front portion 2*b* defining a cavity 2*c* for receiving a correspondingly shaped portion of a complementary connector 1' (shown by the dotted line in FIG. 1).

Each terminal 4 (FIG. 2) comprises an intermediate box-shaped portion 6; a contact portion 7 substantially in the form of an elongated plate projecting frontwards from intermediate portion 6; and a rear portion 10 for connection to an electric cable 11.

Intermediate portion 6 has a bottom wall 12, the rear edge 13 of which defines a stop for the primary retaining means; and a pair of lateral walls 14, each forming an integral coplanar tab 15 extending beyond bottom wall 12 and in turn forming a front stop edge 16 substantially perpendicular to the longitudinal direction of terminal 4, and the function of which is described hereinbelow.

Terminal 4 is inserted inside respective cavity 3 through a rear opening 17 (FIG. 1) of the cavity itself and from which cable 11 extends in use.

The primary retaining means comprise an elastic lance 18 narrower than the distance between tabs 15 of terminal 4, and which projects inside cavity 3 from the bottom wall 19 of the cavity, and extends substantially longitudinally towards the front opening 20 of the cavity. The surface 21 of lance 18 facing inwards of cavity 3 has a tooth 22 with a substantially serrated profile and an inclined side 23 facing rear opening 17, and a side 24 substantially transverse to the axis of cavity 3 and facing front opening 20.

Figure 3:
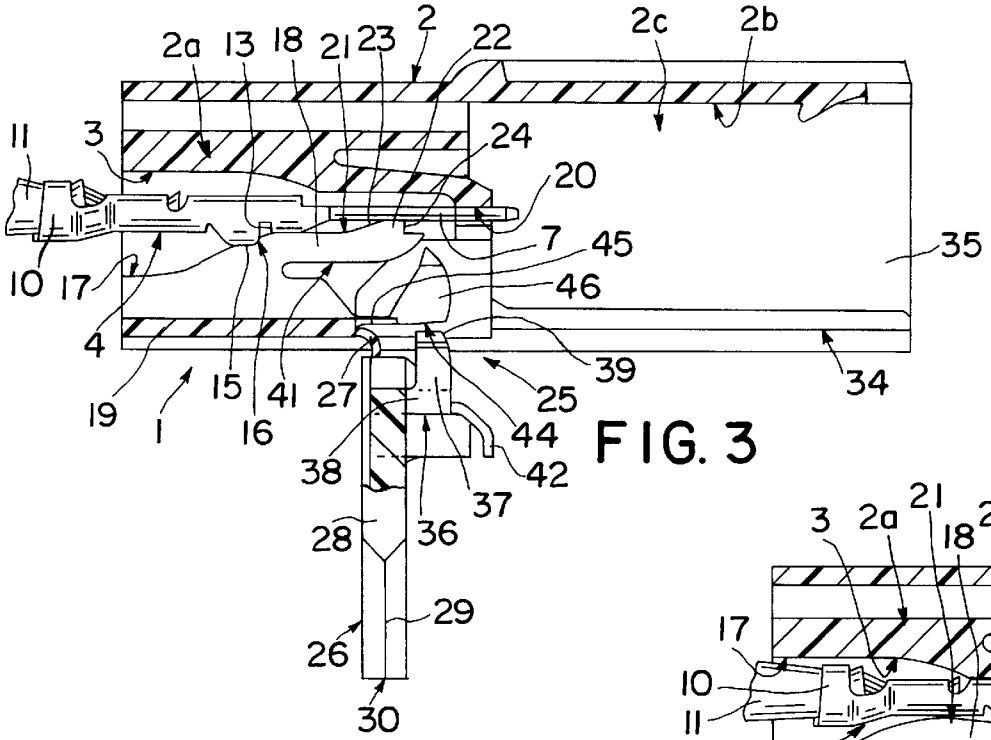
FIG. 3 shows a longitudinal section, as in FIG. 1, of the connector at the preliminary assembly stage.

Tooth 22 therefore permits insertion of terminal 4 which, as it slides along side 23, elastically deforms lance 18 towards wall 19 (FIG. 3); and, upon terminal 4 being inserted fully inside cavity 3 (FIG. 1), lance 18 springs back to the undeformed position by tooth 22 snapping behind rear edge 13 of box portion 6 of terminal 4 which is prevented from being withdrawn by side 24 of tooth 22.

Connector 1 also comprises a secondary retaining device 25 for retaining terminals 4.

Figure 4:
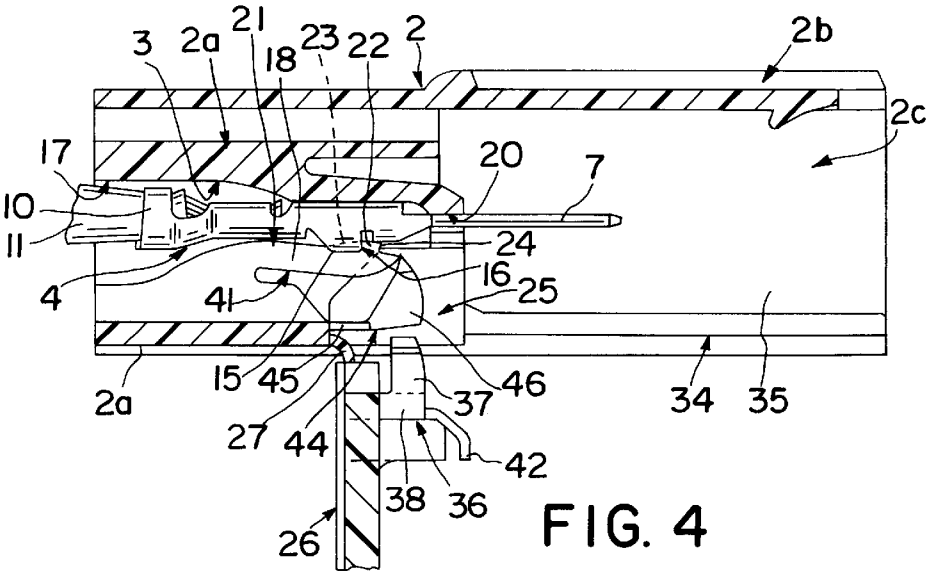

Device 25 comprises a first movable element 26 integral with and extending transversely over the entire width of casing 2, and which defines a movable wall of front portion 2*b* of casing 2, and is hinged to wall 19 by a number of flexible blades 27 so as to rotate between an open position (FIGS. 2, 3, 4) and a closed position (FIG. 1).

The lateral edges 28 of first movable element 26 have respective longitudinal projections 29 with a V-shaped cross section, decreasing gradually in height towards the free end edge 30 of element 26 (FIG. 3), and which, when element 26 is closed, snap into respective correspondingly shaped seats 34 formed on the inner faces of lateral walls 35 of portion 2*b*.

At each cavity 3, first movable element 26 presents a substantially fork-shaped appendix 36 consisting of two flexible arms 37 parallel to and facing each other, and extending, in a direction parallel to the plane of element 26, towards portion 2*a* of casing 2 and from a restraining portion 38 integral with element 26. Arms 37 have respective tapered end portions 39 defined externally by respective surfaces 40 perpendicular to the plane of element 26 and converging with each other.

Arms 37 have an elongated cross section perpendicular to element 26, so that they are substantially rigid perpendicular to, but flexible parallel to, element 26; and the length of arms 37 is such that, when element 26 is closed, end portions 39 extend inside respective cavity 3, and cooperate with the underside surface 41, on the opposite side to surf ace 21, of elastic lance 18, so as to prevent lance 18 from being deformed elastically.

From restraining portion 38 of appendix 36, there projects a shaped appendix 42 extending first at an angle of 45° and then at an angle of 90° in the opposite direction to arms 37. When element 26 is closed, appendix 42 defines a front wall of cavity 3 defining opening 20, and provides for guiding contact portion 7 of terminal 4 towards opening 20 during insertion of the terminal.

For each cavity 3, device 25 also comprises a second movable element 44 extending forwardly and integrally from wall 19 to which it is connected by a flexible hinge blade 45, and which is interposed between first movable element 26 and terminal 4, for expelling the terminal from cavity 3 when first element 26 is closed and the terminal is not correctly engaged by elastic lance 18.

More specifically, the second movable element comprises a pair of substantially triangular portions 46 projecting from blade 45, coplanar with tabs 15 of terminal 4, and facing each other at a distance substantially equal to that between tabs 15 and less than the minimum distance between surfaces 40 of arms 37 measured at the free end of arms 37.

Portions 46 each comprise a first side 48 extending substantially along an extension of blade 45 and, in the undeformed condition, facing appendix 36 of first movable element 26 when this is open; an apex 50 opposite side 48 and located close to the free end of and on the opposite side of elastic lance 18 to the other apex 50; and a second side 51 extending between blade 45 and respective apex 50, and facing a respective tab 15 of terminal 4.

Device 25 operates as follows.

When first movable element 26 is moved towards the closed position, end portions 39 of arms 37 penetrate and are wedged by friction between portions 46 of second movable element 44. A first element 26 is closed further, it takes second element 44 with it and rotates it about blade 45, and portions 46 slide along lateral walls 5 of the cavity until sides 51 of portions 46 are arrested against tabs 15 of terminal 4.

Two situations are therefore possible.

If terminal 4 is correctly engaged by lance 18 which is therefore in the undeformed position, tabs 15 define fixed stops for portions 46 which, by also contacting lateral walls 5 of cavity 3, are prevented from flexing outwards.

As first movable element 26 is closed further, surfaces 40 of arms 37 slide along the inside of portions 46; and the slope of surfaces 40 flexes arms 37 towards each other so that they penetrate further between portions 46 and are eventually positioned substantially contacting surface 41 of lance 18 which is thus prevented from flexing.

Conversely, in the event terminal 4 is not fully inserted inside respective cavity 3 (FIG. 3), the thrust exerted by portions 46 on tabs 15 of the terminal is not counteracted by the restraining action exerted by tooth 22 on the terminal. Consequently, as first movable element 26 is closed further, no loss of adherence is incurred between surfaces 40 and portions 46, so that second movable element 44 transmits the thrust to terminal 4 which is partially expelled from cavity 3; and, as first movable element 26 is closed yet further, arms 37 contact lance 18, the residual deformation of which towards wall 19 prevents element 26 from being closed.

The advantages of connector 1, and particularly of device 25, according to the present invention will be clear from the foregoing description.

In particular, in the event any one of the terminals is not correctly inserted inside the respective cavity and engaged by the primary retaining means, it is at least partially expelled from the cavity, so that, even if element 26 is forced into the closed position, e.g. by pushing it so as to break arms 37 of the poorly inserted terminal, no electrical contact, however precarious, can be made by the terminal, thus enabling the fault to be detected immediately when testing the electric system of which the connector forms part. Moreover, expulsion of the poorly inserted terminal from the cavity also provides for immediately identifying the terminal at fault, which may then be inserted correctly inside the cavity.

Clearly, changes may be made to connector 1 as described and illustrated herein without departing from the scope of the present invention.

In particular, connector 1 may comprise any number of terminals 4; changes may be made to the design and location of appendix 36 and second element 44, or to the design and arrangement of the part of terminal 4 with which element 44 cooperates; and, when terminal 4 is correctly engaged by lance 18, disconnection of first movable element 26 and terminal 4 may be effected by deforming an appropriately designed second movable element 44 as opposed to appendix 36 of first movable element 26.

We claim:

1. An electric connector (1) comprising an insulating casing (2) with at least one axial cavity (3); at least one electric terminal (4) housed inside the cavity (3); primary retaining means (18) for retaining the terminal (4) inside the cavity (3); and secondary retaining means (25) in turn comprising at least a first movable element (26) designed to snap into a closed position on the casing (2) and to cooperate in said closed position with said primary retaining means (18), for ensuring correct engagement and preventing release of said terminal (4) by said primary retaining means (18); wherein said secondary retaining means (25) comprise at least a second movable element (44) interposed between said first movable element (26) and said terminal (4), and which provides for transmitting to the terminal (4) the thrust exerted on said first movable element (26), when the first movable element (26) is moved towards said closed position, so as to at least partially expel the terminal (4) from the cavity (3) in the event the terminal (4) is not correctly engaged by said primary retaining means (18); said first and said second movable elements (26, 44) having respective engagement portions (36, 46) cooperating mutually when subjected to said thrust; and at least one (36) of said portions being elastically deformable by said thrust, for releasing said first movable element (26) from said terminal (4) in the event the terminal (4) is correctly engaged by said primary retaining means (18).

2. A connector as claimed in claim 1, wherein said first movable element (26) is integral with and hinged to said casing (2).

3. A connector as claimed in claim 1, wherein said second movable element (44) is integral with and hinged to said casing (2).

4. A connector as claimed in claim 1, wherein said second movable element (44) comprises a pair of said engagement portions (46) spaced in relation to each other and cooperating with respective lateral stop surfaces (16) of said terminal (4).

5. A connector as claimed in claim 4, wherein said engagement portion (36) of said first movable element (26) comprises a pair of flexible arms (37) designed to penetrate at least partially between and to cooperate frictionally with said engagement portions (46) of said second movable element (44).

6. A connector as claimed in claim 5, wherein said arms (37) have respective end portions (39) defined externally by inclined, converging surfaces (40).

* * * * *